United States Patent [19]

Uchida et al.

[11] Patent Number: 4,510,396

[45] Date of Patent: Apr. 9, 1985

[54] METHOD OF CONTROLLING AUTOMATIC STOP AND RESTART OF AN ENGINE

[75] Inventors: Shigekatsu Uchida; Takao Akatsuka; Takahide Kawamura, all of Aichi, Japan

[73] Assignee: Toyota Jidosha Kabushiki Kaisha, Toyota, Japan

[21] Appl. No.: 394,728

[22] Filed: Jul. 2, 1982

[30] Foreign Application Priority Data

Jul. 24, 1981 [JP] Japan ..... 56-115990

[51] Int. Cl.[3] ..... F02N 11/08

[52] U.S. Cl. ..... 290/30 R; 290/38 C; 290/38 E; 123/179 BG

[58] Field of Search ..... 290/30 R, 38 E, 38 C; 123/179 A, 179 B, 179 BG, 198 DB

[56] References Cited

U.S. PATENT DOCUMENTS

| | | | |
|---|---|---|---|
| 4,006,723 | 2/1977 | Schmidt | 123/179 BG |
| 4,104,688 | 8/1978 | Pecsi | 123/179 BG |
| 4,192,279 | 3/1980 | Maisch et al. | 123/198 DB |
| 4,286,683 | 9/1981 | Zeigner et al. | 290/38 E |
| 4,364,343 | 12/1982 | Malik | 123/179 B |
| 4,402,286 | 9/1983 | Pagel | 123/179 BG |

*Primary Examiner*—S. J. Witkowski
*Assistant Examiner*—Shelley Wade
*Attorney, Agent, or Firm*—Oblon, Fisher, Spivak, McClelland & Maier

[57] ABSTRACT

An engine of a motor vehicle is automatically stopped under predetermined conditions and automatically restarted under other predetermined conditions. The engine is restarted by a starter which is driven in response to an engine start signal. In automatically restarting the engine, the engine start signal is generated when restart conditions are fulfilled and a starter command is generated in a microcomputer. An operation of a clutch pedal is one of the restart conditions. The clutch pedal is provided therearound with a lower switch and an upper switch to detect an amount of a depression of the clutch pedal. The starter command is masked for a predetermined period of time starting from the time when the upper switch is turned OFF from the upper switch has been ON.

6 Claims, 8 Drawing Figures

METHOD OF CONTROLLING AUTOMATIC STOP AND RESTART OF AN ENGINE

BACKGROUND OF THE INVENTION

This invention relates to a method of controlling automatic stop and restart of an engine for automatically stopping an engine under some predetermined conditions, and thereafter, automatically restarting the engine under other predetermined conditions.

In general, during running on a road, when a vehicle has to be stopped for a long period of time because of a traffic jam due to a signal waiting, an accident caused by another vehicle or the like, an engine may be temporarily stopped, and thereafter, restarted after the traffic jam has gone. This is done so as to avoid useless fuel consumption due to an idle operation for a long period of time.

Referring to the running through an urban district, the periods of time for vehicle stopping in the urban district comprises a fairly large percentage of the whole operating time of the vehicle, and the amount of exhaust gases and the quantity of fuel consumed therefor are not neglectable. Therefore, it is conceivable that, upon stopping of the vehicle for the signal waiting and the like during running in the urban district, the engine of the vehicle is stopped by manual operation. However, the stopping of the engine by manual operation each time of the signal waitings leads to the manually engine restarting operation, thereby resulting in a troublesome operation and a delayed starting operation of the vehicle.

There has heretofore been developed an automatic engine stop-restart system wherein, when a motor vehicle is stopped at an intersection or the like during running through an urban district, if it is desirable to temporarily stop the engine for the purpose of improving the fuel consumption rate, the engine is automatically stopped, and thereafter, automatically restarted by a normal starting operation, which is effected at the time of starting the vehicle, such as a depression of a clutch pedal.

In the conventional system of the type described, when a starting signal is fed to a starter in operational association with a clutch operation to restart the engine, judgement of necessity for cutting off this starting signal has been obtained when either one condition (1) "the engine rotational speed exceeds a predetermined value (550 rpm for example)" or the other condition (2) "the alternator is in the generating condition" is fulfilled.

However, if judgement is obtained based on either one of the above-described conditions, then there has been presented such a disadvantage that, when information of the engine rotational speed cannot be obtained due to a trouble caused to the sensor for example, regardless of rotation of the engine, the starter is driven, thus resulting in a damaged starter.

SUMMARY OF THE INVENTION

The present invention has as its object the provision of a method of controlling the automatic engine stop and restart, capable of preventing damages of a starter during the start of an engine.

A method according to the present invention is provided for automatically stopping an engine and automatically restarting the engine, wherein the method comprises the steps of detecting operating conditions of various components of a motor vehicle to judge a fulfillment of predetermined conditions, automatically stopping the engine when the fulfillment of the predetermined conditions is judged, generating a starter command capable of forming an engine start signal to be fed to starting means of the engine within a predetermined range of a rotational speed of the engine, judging as to whether or not restart conditions of the engine are fulfilled, the restart conditions including a predetermined restarting operation, generating the engine start signal when a fulfillment of the restart conditions is judged and the start command is generated, and masking the starter command for a predetermined period of time in synchronism with the predetermined restarting operation.

In the preferred embodiment of the present invention, the aforesaid function of automatically stopping and restarting the engine can be set or released by the main switch, in restarting the engine after the aforesaid function has been set by the main switch and the engine has been automatically stopped, the fact that a clutch lower switch is energized when a clutch pedal is depressed substantially to the full stroke is made as a condition of restart, and, a starter command is masked for a predetermined period of time from the time when the clutch pedal is released and the clutch lower switch is deenerized. In other words, the starter command issued when the engine rotational speed reaches a predetermined value or less, and, is discontinued to issue from the time when the engine rotational speed exceeds the predetermined value, during which period of time the starter command is masked for the predetermined period of time from the time when the clutch lower switch is deenerized.

In consequence, according to the present invention, even if a double clutch operation is performed during restart of the engine, the starter can be protected against damages.

BRIEF DESCRIPTION OF THE DRAWINGS

FIGS. 2 through 4 are explanatory views respectively showing operation modes in the control circuit 1, in which FIG. 2 shows an operation mode when a function of automatically stopping an engine and thereafter automatically restarting (hereinafter referred to as "ERS") is set, FIG. 3 shows an operation mode when the engine is automatically stopped and FIG. 4 shows an operation mode when the engine is automatically restarted;

DESCRIPTION OF THE PREFERRED EMBODIMENT

Figure 1:
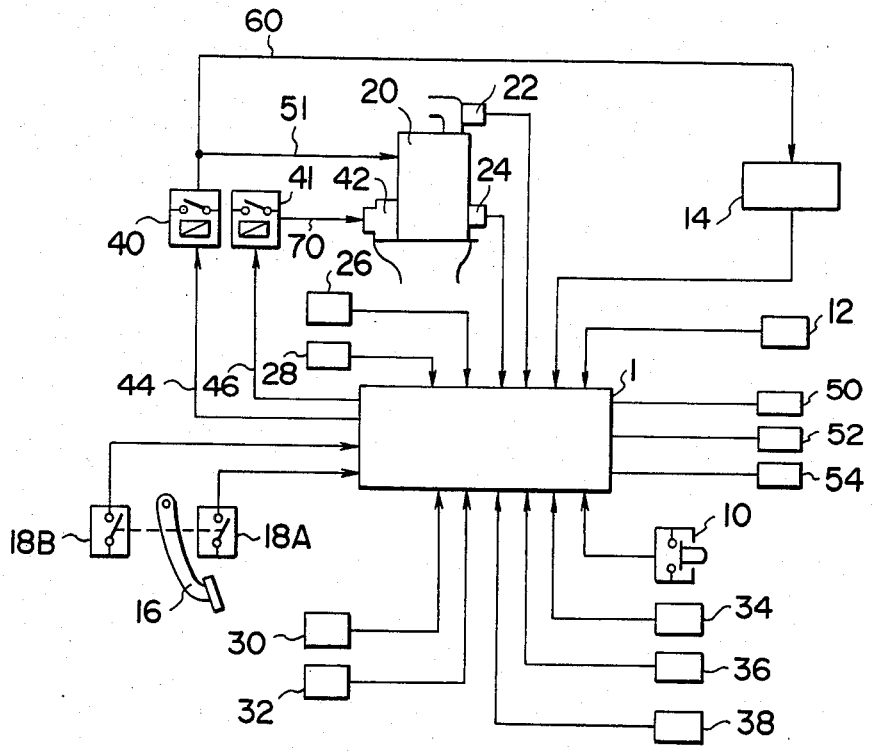
FIG. 1 is a block diagram showing the general arrangement of the automatic engine stop-restart system according to the present invention.

Detailed description will hereunder be given of an embodiment of the present invention with reference to the drawings. FIG. 1 shows the general arrangement of the automatic engine stop-restart system according to the present invention, in which reference numeral 1 indicates a control circuit is a microcomputer comprising: a central processing unit (hereinafter referred to as "CPU"); RANDOM ACCESS MEMORY (hereinafter referred to as "RAM"); READ ONLY MEMORY (hereinafter referred to as "ROM"); INPUT/OUTPUT (hereinafter referred to as "I/O") interface; and the like. Detection outputs from various sensors are fed to this control circuit 1.

Designated at 10 is a main switch by which the aforesaid ERS is set or released. After the engine is started by normal operation, if the main switch 10 is pressed under predetermined conditions, then ERS is set. Furthermore, after ERS is set, ERS can be released by manual operation by pressing the main switch 10 again. Otherwise, ERS is automatically releasable under predetermined condtions, which will be described hereinafter.

Further, designated at 12 is a vehicle speed sensor for detecting whether the vehicle is running or stopped. A detecting output from this sensor 12 is used for judgement as to whether the engine is automatically stopped. Denoted at 14 is an ignition circuit, from which ignition pulse signals are fed to the control circuit 1, where the pulse signals are processed as being an engine rotation signal. As will be described hereinafter, this engine rotation signal is used for judgement of various conditions including the setting of ERS, automatic stop and restart of the engine, and release of ERS. Designated at 16 is a clutch pedal, 18A and 18B a clutch upper switch and clutch lower switch which are operationally associated with the clutch pedal 16 for ON-OFF operation. Both of these switches are used for detecting the amount of the depression of the clutch pedal 16. The clutch upper switch 18A is turned ON when the clutch pedal 16 is depressed to a predetermined percentage to the full stroke, e.g., 30% or more, whereby a signal indicating that the clutch pedal 16 has been depressed to 30% or more is fed to the control circuit 1, so that the control circuit 1 can control the various components not to stop the engine. The clutch lower switch 18B is turned ON when the clutch pedal 16 is depressed to the full stroke, whereby a signal permitting an automatic engine start is fed to the control circuit 1.

The engine 20 is provided thereon with a water temperature sensor 22 adapted to be energized when the temperature of engine cooling water reaches a predetermined value and a hydraulic pressure switch 24 adapted to be energized by a predetermined engine oil pressure, and detection outputs therefrom are fed to the control circuit 1. Designated at 26 is a change-over switch for indicating the generation of the alternator, which is turned OFF when the alternator is in the generating operation. Denoted at 28 is a battery voltage input for detecting the conditions of a battery, and 30 a magnet switch for controlling the operation of the air conditioner, which switch is turned on while the air conditioner is in operation.

Further, denoted at 32 is a head lamp switch for turning head lamps ON or OFF, and 34 a wiper switch for detecting the operating conditions of a wiper. Use of electrical equipments such as head lamps are detected through these switches 30, 32 and 34, i.e., if these electrical equipments have high electical load. Indicated at 36 is a turn signal switch for detecting whether the vehicle is to turn rightward or not, and 38 a door switch for detecting the opened or closed state of a door on the side of a driver's seat. Out of these detection outputs, the former is utilized as an input for judging an automatic engine stop condition, and the latter is used as an input for judging an ERS setting condition and an ERS release condition. Further, designated at 50 is a slope sensor which detects if a slope of the road surface is more than a predetermined value (2 degrees for example) or not, and, when the slope is more than the predetermined value, the slope sensor is turned ON. Denoted at 52 is an idle switch for detecting if the engine is in idling or not, and when the engine is in idling, the idle switch is turned ON. Denoted at 54 is a defogger switch for detecting if a defogger is in use or not.

After ERS is set by the main switch 10 under the predetermined conditions fulfilled, the automatic stop and restart of the engine 20 are performed as will be described hereunder. More specifically, when the conditions of stopping the engine 20 are fulfilled, the control circuit 1 feeds an engine stop signal 44 to a fuel cut relay 40, whereby the fuel cut relay 40 feeds a fuel cut signal 51 to a fuel cut solenoid, not shown, in a fuel supply system of the engine 20, and feeds an ignition cut signal 60 to the ignition circuit 14, so that the engine can be stopped. To automatically stop the engine, such an arrangement may be adopted that only the ignition cut is effected without performing the fuel cut. In this case, there is presented the disadvantage that the drive feeling is deteriorated because the engine tends to be subjected run-on.

On the other hand, under a situation where ERS is set, when the clutch pedal 16 is fully depressed during engine stopping to turn, the clutch lower switch 18B ON and the other conditions of the automatic engine start to be described hereunder are fulfilled, the control circuit 1 feeds an engine start signal 46 to a starter relay 41, whereby the starter 42 is energized, so that the engine 20 can be started.

Figure 4:
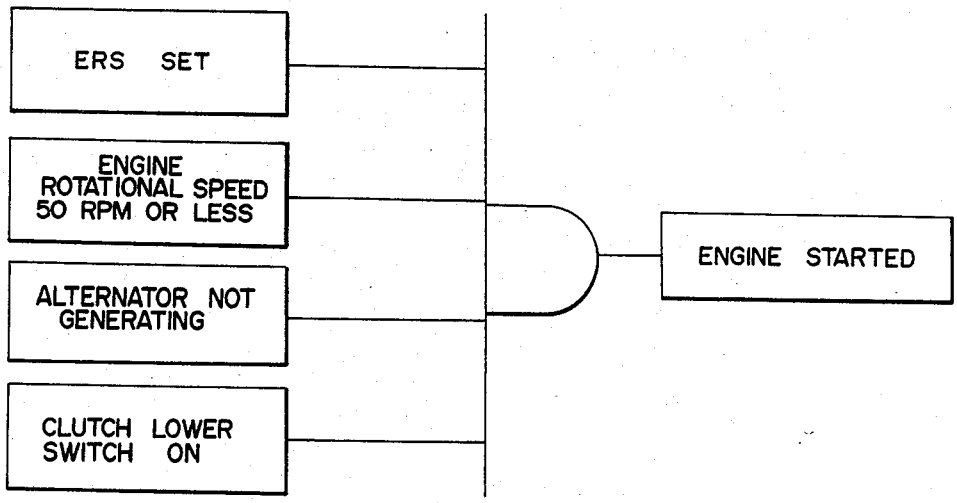
Figure 2:
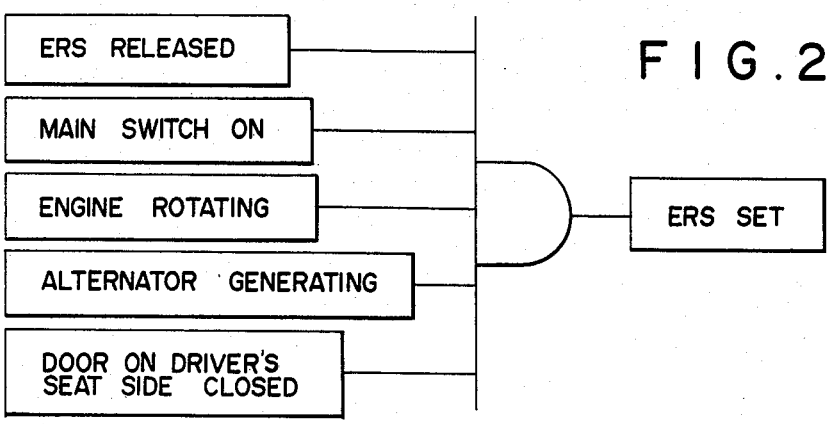
Figure 3:
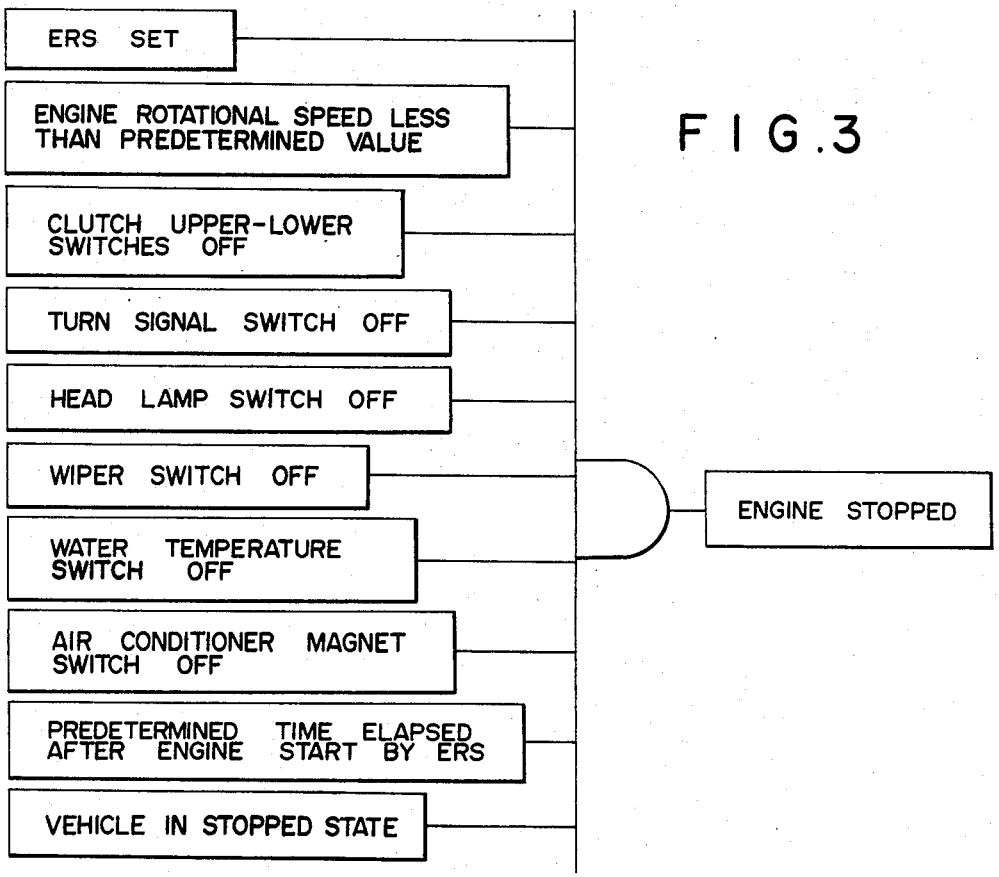

Description will hereunder be given of the respective operation modes of the automatic engine stop-restart system as shown in FIG. 1 including the ERS setting mode, the engine stop mode and engine start mode after ERS is set with reference to FIGS. 2 through 4. FIG. 2 shows the operation mode of ERS setting, and, when "AND" of the following five conditions is established as shown in FIG. 2, ERS setting can be done.

(1) ERS setting has been released.
(2) The main switch for ERS setting is on.
(3) The engine is rotating, the engine rotational speed is 400±50 rpm or more, for example.
(4) The alternator is in the generating operation.
(5) The door on the side of the driver's seat is in the closed state (detected by the door switch 38).

There are two cases of releasing ERS setting in (1), including one case of manually releasing through pressing on the main switch 10 and the other case of automatically releasing. These two cases will be described hereinafter. Judgement as to whether the engine is rotating or not is made through the engine rotational speed in (3) and the generating condition of the alternator in (4). This is done for reliably detecting if the engine is rotating or not.

FIG. 3 shows the operation mode of the automatic engine stop. As shown in FIG. 3, when "AND" of the following conditions (1) through (13) is established, the engine is automatically stopped.

(1) ERS has been set.
(2) The engine rotational speed is predetermined value, e.g., 850 rpm or less.
(3) Both the clutch upper switch 18A and the clutch lower switch 18B are OFF, i.e., the clutch pedal 16 has not been depressed to a predetermined value or more.

(4) The turn signal switch 36 is OFF, i.e., a right turn signal is not emitted.

(5) The head lamp switch 32 is OFF.

(6) The wiper switch is OFF.

(7) The water temperature sensor 22 is OFF, i.e., the temperature of engine cooling water remains within a specific temperature range, e.g., 75° C.~105° C.

(8) The air conditioner magnet switch 30 is OFF.

(9) A predetermined period of time, 4 SEC for example, has elapsed after the engine is started by ERS.

(10) The vehicle is in a stopped state.

(11) The slope sensor 50 is OFF.

(12) The idle switch 52 is OFF.

(13) The defogger switch 54 is OFF.

Out of above-described conditions, "(2) The engine rotational speed is 850 rpm or less" is adopted in consideration of that during racing the automatic engine stop is not to be performed, and "(3)" is provided for the reason that the clutch pedal can be depressed only when the engine is started or the gear shift is effected, and in this system the engine can be restarted by the depression of the clutch pedal.

(4) is adopted as a condition of judging because, at the time of right turn of the vehicle, the driver is required to pay attention to ascertaining the presence of a car running in the opposite direction and the like, and, it is not desirable to stop the engine under the aforesaid conditions. The reason why (5), (6), (8) and (13) are utilized for judging the engine stop is that it is avoided to overdischarge the battery due to the engine stop at a high electrical load. Condition (7) is adopted for not stopping the engine in the low and high temperature ranges of the engine cooling water because it is difficult for the engine to start in those temperature ranges. Condition (9) is adopted for preventing the automatic engine stop and restart from being repeated within a short period of time. Condition (10) "The vehicle is in a stopped state" is judged by the presence of the change in level of a detection output (pulse train signal) of the vehicle speed sensor 12.

As has been described hereinabove, in the automatic engine stop-restart system according to the present invention, the engine rotation signal and the clutch signal operationally associated with the clutch pedal are used as the conditions of judging whether the engine should be stopped automatically or not.

FIG. 4 shows the operation mode of the automatic engine start by ERS. As shown in FIG. 4, when "AND" of the following conditions (1) through (4) is established, the engine is automatically restarted.

(1) ERS has been established.

(2) The engine rotational speed is less than a set rotational speed, e.g., 50 rpm or less.

(3) The alternator is not in the generating condition.

(4) The clutch lower switch 18B is ON, i.e., the clutch pedal is fully depressed.

Release of ERS after ERS has been set is performed as follows:

(A) To release by manual operation

After the main switch 10 has been pressed, if the main switch 10 is pressed again, then ERS setting is released.

(B) To automatically release (1) When the engine is restarted by manual operation of the ignition switch (2) When the door on the side of the driver's seat is opened (3) When the battery is lowered in voltage (4) When a predetermined period of time, e.g., 2 SEC, has elapsed until the engine rotational speed reaches a certain value, 550 rpm for example, at the time of restart by ERS.

In all of the above-described cases, ERS setting is automatically released. Out of the above-mentioned conditions, (1) is adopted for that, when the engine is restarted by manual operation of the key switch in spite of that the engine has been automatically stopped by ERS, ERS must be released to prevent ERS to drive the starter again. (2) is adopted for that, in consideration of a replacement of the driver by a new one, when the door switch 38 is actuated, ERS is released, so that a driver unfamiliar with ERS may not be confused. (3) is adopted because, when the ERS is kept on under lowered battery capacity, the restart cannot easily be effected. Similarly, (4) is adopted for that, in consideration of the lowered capacity of the battery, when the engine is restarted under the condition (4), ERS is released, and thereafter the engine is started and stopped by means of an ordinary ignition switch.

In addition, in the description of FIG. 3, there have been included signals of use of the air conditioner and use of the defogger. However, needless to say, in the vehicle without those components, there is no necessity for providing those two types of signals.

Figure 5:
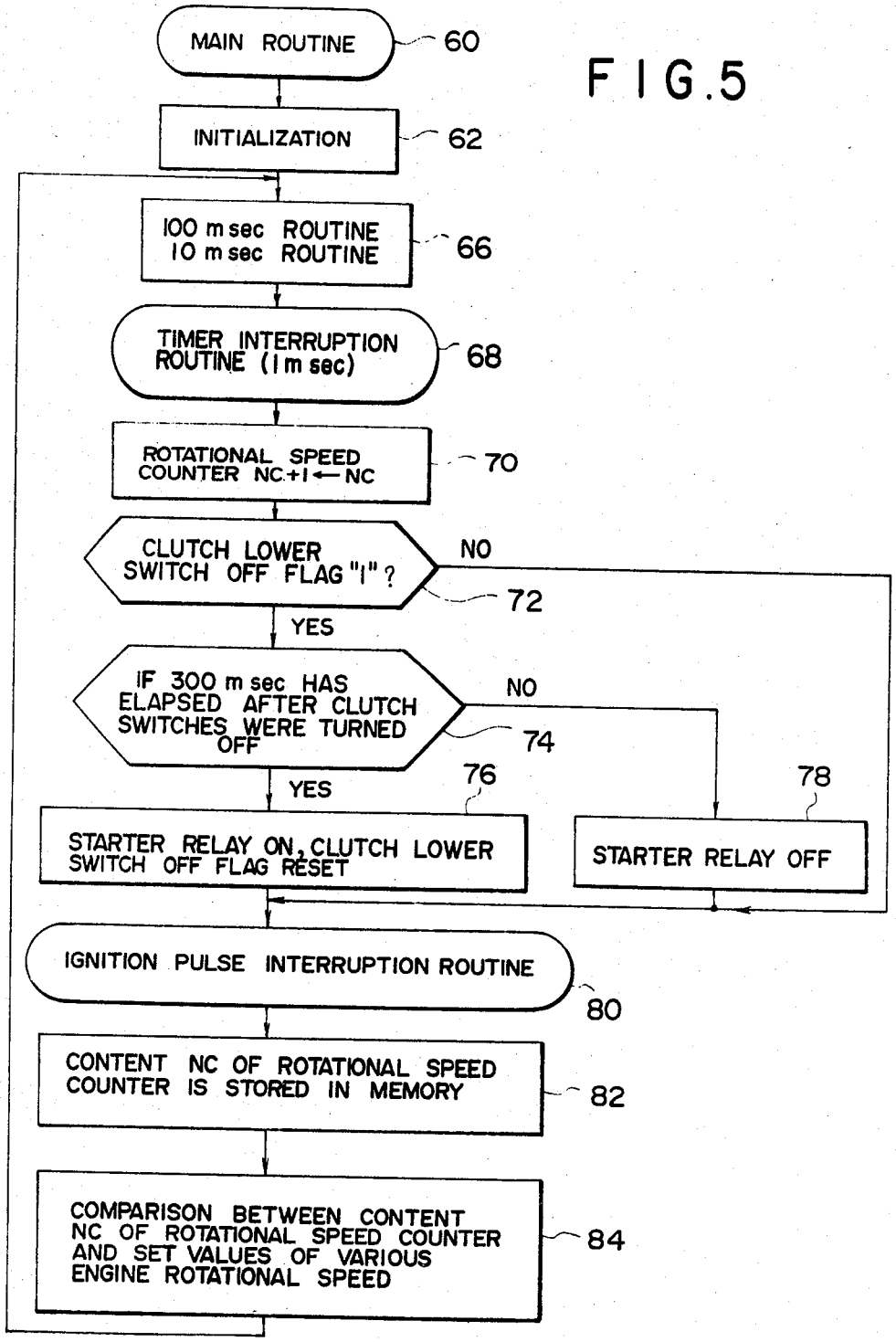
FIG. 5 is a flow chart showing an embodiment of the method of controlling the automatic stop and restart of the engine according to the present invention.
Figures 6A, 6B, 6C:
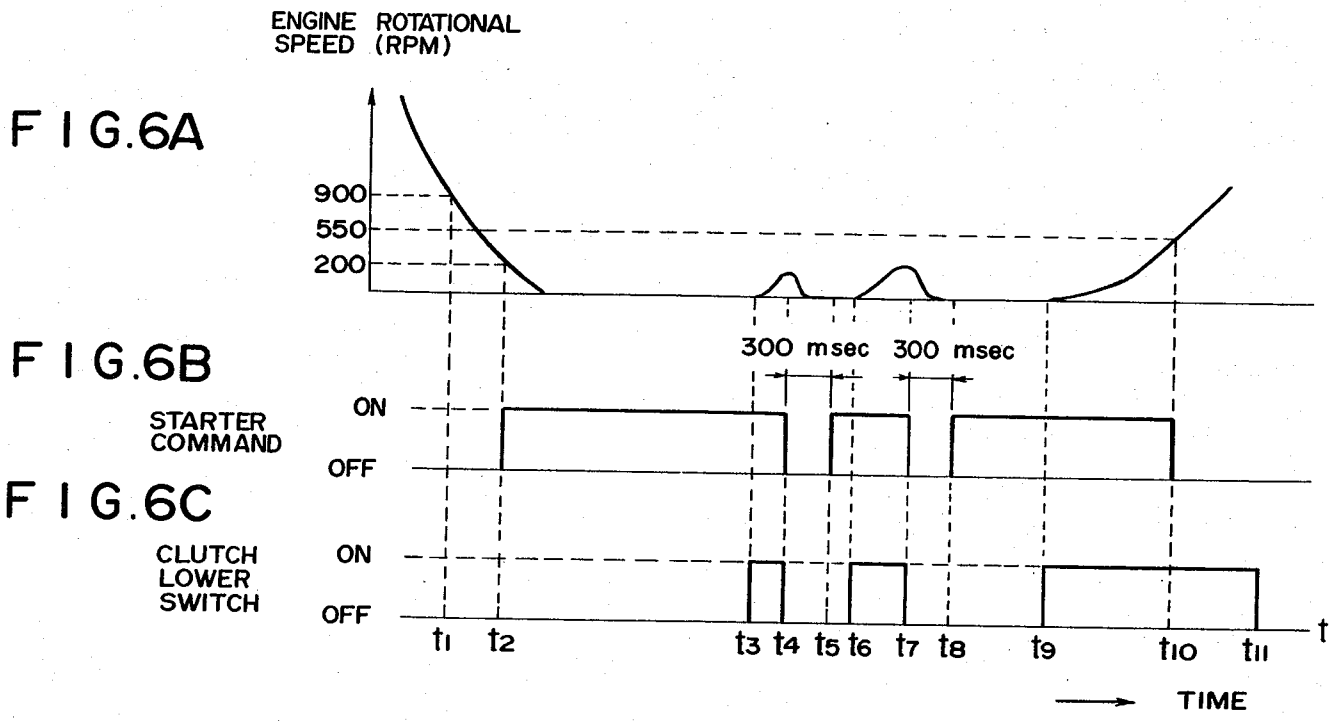
FIG. 6A is a characteristics curve diagram showing the engine rotational speed.
FIG. 6B is a timing chart showing the starter command.
FIG. 6C is a timing chart showing ON-OFF operation of the clutch lower switch.

Description will hereunder be given of an embodiment of the method of controlling the automatic engine stop and restart according to the present invention with reference to FIGS. 5 and 6. FIG. 5 shows the contents of process in the control circuit 1 (Refer to FIG. 1) when the engine is restarted after it has been automatically stopped. This process has such contents that, after the clutch pedal 16 is depressed to restart the engine, interruption of generating of a starter command is synchronized with the time when the clutch pedal 16 is released, more accurately, the time when the clutch lower switch 18B is turned OFF, and the stopped state is continued for a predetermined period of time, e.g., 300 m sec from the aforesaid time. Even if the clutch pedal is depressed again for the predetermined period of time, the engine start signal 46 is not generated because of lack of the starter command. The operations of the control circuit 1 are shown in FIGS. 6B and 6C.

In FIG. 5, when the processing of the main routine is started in Step 60, the process is transferred to Step 62 where there is effected the iniatilization, i.e., clearing of 37 RAM" in the control circuit 1, clearing of contents of various registers of I/O interface also in the control circuit 1 and setting of the initial values in these "RAM" and registers. In Step 66, there are processed routines including a check routine of automatic engine stop-restart conditions and the like which are actuated at intervals of 100 m sec, and other routines including a vehicle speed detecting routine and the like, which are actuated at intervals of 10 m sec, and then, the process is transferred to Step 68. In Step 68, there is started processing of timer interruption routines actuated at intervals of 1 m sec for detecting the engine rotational speed and for masking a starter command for feeding an engine start signal 46 to the starter relay 41 for a predetermined period of time after the clutch pedal has been released. Then, in the succeeding Step 70, the count contents of the rotational speed counter NC is incremented by +1. Namely, the count contents NC of the rotational speed counter indicates the number of times of timer interruptions, which are actuated in intervals of 1 m sec.

In Step 72, judgement is made as to whether a clutch lower switch OFF flag is "1" or not, i.e., the clutch pedal 16 is released or not after the clutch pedal 16 has been depressed. When the clutch lower switch OFF flag is judged as "1" in Step 72, the process is transferred to Step 74, where judgement is made as to whether 300 m sec has elapsed or not after the turn-OFF of the clutch lower switch 18B. If not, the process is transferred to Step 78 to turn the starter relay 41 OFF (in other words, the starter command is masked at this time).

When "Yes" is judged in Step 74, the process is transferred to Step 76 where the starter relay 41 is turned ON (in other words, the starter command issues at this time), the clutch lower switch OFF flag is reset, and the process is transferred to the succeeding Step 80.

When "No" is judged in Step 72, the process jumps to Step 80, where there is started processing of an ignition pulse interruption routine. In Step 82, there is received in "RAM" is the control circuit 1 the engine rotational speed data calculated on the basis of ignition pulse number taken in the measuring time corresponding to the count contents NC of the rotational speed counter counted in Step 70. More specifically, each of the ignition pulses issued every turn of the engine through a rotational angle of 180° in a four cylinder engine, and hence, the engine rotational speed can be readily obtained from the ignition pulse number. In Step 84, the engine rotational speed stored in "RAM" and set values of various engine rotational speeds are compared with each other, whereby the respective conditions of the automatic engine stop and restart are judged, and then, the process is transferred to Step 66, where there is effected processing similar to the above.

FIG. 6A indicates the characteristics of the engine rotational speed, showing the progress from the running condition to the restarting condition through the stopped condition of the vehicle. In this system, for a period of time t ($t_1 \leqq t \leqq t_2$) during which the engine rotational speed is lowered, for example, from 900 to 200 rpm in the stopped state of the vehicle, a fuel cut signal is fed from the control circuit 1 to the fuel cut solenoid through the relay 40 so as to cut the fuel injection. After the tire point $t_2$ the fuel cut condition is released.

In this embodiment, the engine start signal is adapted to be generated only when the starter command is generated and the restart condition mentioned above is fulfilled. The starter command is adapted to be issued when the engine rotational speed is lowered to reach a first predetermined level, e.g., 200 rpm, and to be disconnected to be issued when the engine rotational speed exceeds a second predetermined level, e.g., 550 rpm. The generation of the starter command is interrupted in response to restart operation, more particularly to interruption of the restart operation. Namely, if the clutch pedal is depressed at the time $t_3$ (the clutch lower switch on) after the automatic engine stop and released at the time $t_4$, the starter command is masked for the period of time of 300 m sec ($t_4 \leqq t \leqq t_5$) in this embodiment. Similarly, if the clutch pedal is depressed at the time $t_6$ and released at the time $t_7$, the starter command is masked for the period of time of $t_7 \leqq t \leqq t_8$. If the clutch pedal is depressed at the time $t_9$ and released at the time$_{11}$, the starter command will not be masked because the feed of the starter command has been stopped.

In addition, in this embodiment, the starter command is masked for a predetermined period of time upon releasing the clutch pedal, however, there is no intention to limit the invention to this specific method disclosed, such an arrangement may be adopted that the period of time for masking is changed with the rotational speed of the engine being constantly monitored, or the starter command is discontinued to be fed at the time when the engine rotational speed exceeds a predetermined value.

What is claimed is:

1. Method of controlling automatic stop and restart of an engine of a motor vehicle, wherein said method comprises the steps of:

(a) detecting operating conditions of various components of said motor vehicle;

(b) judging as to whether or not first predetermined conditions for automatic engine stop are fulfilled based on detected operating conditions;

(c) judging as to whether or not second predetermined conditions for automatic engine restart are fulfilled based on detected operating conditions, said second predetermined conditions including a restarting operation;

(d) automatically stopping said engine when said first predetermined conditions are fulfilled;

(e) generating a starter command when an engine rotational speed is lowered to reach a first predetermined value, said starter command being discontinued to be generated when the engine rotational speed is increased to reach a second predetermined value;

(f) feeding the engine start signal to a starting means when a judgement is made that the second predetermined conditions are fulfilled druing said starter command being generated;

(g) masking said starter command for a predetermined period of time in synchronism with interruption of said restarting operation.

2. Method of controlling automatic stop and restart of an engine as set forth in claim 1, wherein said restarting operation comprises an operation of a clutch pedal.

3. Method of controlling automatic stop and restart of an engine as set forth in claim 2, wherein said starter command is masked for a predetermined period of time from the time when the fully depressed clutch pedal is returned to a predetermined position.

4. Method of controlling automatic stop and restart of an engine as set forth in claim 3, wherein a switch is disposed at said predetermined position and said starter command is masked starting from the time when said switch is turned OFF after said switch has been turned ON.

5. Method of controlling automatic stop and restart of an engine as set forth in claims 1, 2, 3 or 4, wherein said starting means comprises a starter relay and a starter and said engine start signal is fed to said starter relay to drive said starter when said restart conditions are fulfilled, with said starter command being generated.

6. Method of controlling automatic stop and restart of an engine as set forth in claim 5, wherein said first predetermined value is 200 rpm and said second predetermined value is 500 rpm.

* * * * *